United States Patent [19]

Kasoff et al.

[11] Patent Number: 4,932,045

[45] Date of Patent: Jun. 5, 1990

[54] WATERPROO DIGITAL LAP COUNTER

[75] Inventors: James A. Kasoff, Baltimore; William C. Stone, Derwood, both of Md.

[73] Assignee: Kasoff Enterprises, Inc., Baltimore, Md.

[21] Appl. No.: 227,134

[22] Filed: Aug. 2, 1988

[51] Int. Cl.[5] ..... G06M 1/02; G06M 1/08

[52] U.S. Cl. ..... 377/24.2; 377/5

[58] Field of Search ..... 377/5, 24.2

[56] References Cited

U.S. PATENT DOCUMENTS

| | | | |
|---|---|---|---|
| 1,261,369 | 4/1918 | Eacret | 235/1 B |
| 1,340,036 | 5/1920 | Foss | 235/91 PR |
| 3,000,559 | 6/1958 | Dom | 235/113 |
| 4,019,030 | 4/1977 | Tamiz | 36/34 R |
| 4,175,446 | 11/1979 | Crowninshield | 73/172 |
| 4,222,563 | 9/1980 | Heftler et al. | 273/DIG. 26 |
| 4,223,211 | 9/1980 | Allsen et al. | 377/24.2 |
| 4,309,599 | 1/1982 | Myers | 377/24.2 |
| 4,466,204 | 8/1984 | Wu | 377/24.2 |
| 4,557,215 | 12/1985 | Petersson | 116/222 |
| 4,700,369 | 10/1987 | Siegel et al. | 377/24.2 |
| 4,823,367 | 4/1989 | Kreutzfeld | 377/5 |

*Primary Examiner*—John S. Heyman

*Attorney, Agent, or Firm*—Kenyon & Kenyon

[57] ABSTRACT

A waterproof digital lap counter automatically counting and indicating the number of laps traversed by a swimmer having the lap counter attached to a hand or foot comprises a LCD array including a digital counter, driver and LCD embedded within a sealed inner housing which is slidably and nonrotatably supported in an outer housing. Counting and indication of laps traversed occurs automatically and is triggered by abutment of the lap counter against the side of the swimming pool during the swimming stroke or flip turn of the swimmer. Abutment of the lap counter against the side of the pool momentarily closes a switch which sends an input signal to the LCD array representative of a lap traversed. The LCD array counts and provides a visible indication of the number of input signals received which corresponds to the total number of laps traversed.

16 Claims, 6 Drawing Sheets

WATERPROO DIGITAL LAP COUNTER

The present invention relates generally to a waterproof counter for counting and indicating the number of laps traversed by a swimmer in a pool and more particularly, to a waterproof digital lap counter which upon abutment against the wall of a swimming pool automatically increments the total count of a count display thereby indicating the total number of laps traversed by a swimmer having the lap counter attached to an extremity.

BACKGROUND OF THE INVENTION

Athletic training for swimmers and persons wishing to keep fit by swimming often consists of swimming a specified distance on a regular basis. This is typically done in the confines of an indoor or outdoor swimming pool having a specified length and in lanes designated for this purpose. Each length of the pool traversed is referred to as a lap. A person swimming laps can determine the total distance traveled by counting the number of laps he has traversed and multiplying this figure by the lane length. The act of mentally counting laps can be both mentally taxing and inaccurate if the person is distracted for some reason, especially when the number of laps traversed approaches three digits.

One solution to this problem comprises mounting a large counting device at the end of a swimming lane adjacent the end wall of the pool. In order to register a lap for counting, the swimmer must reach up out of the water to tap the device as he reaches the wall at the end of the lap. One of the disadvantages or problems incurred with this solution is brought about by reaching up and out of the water at the end of the lap. This is an additional motion which interrupts the swimmer's stroke and/or prevents him from employing a flip turn. In addition, another problem presented with this device is that it can only be used with one swimmer per lane and, in most instances during practice in swimming pools, there are several people swimming in the one lane at a given time.

SUMMARY OF THE INVENTION

Applicant's invention solves the problems of lap counting by providing a convenient and automatic means for counting and indicating the number of laps traversed by a swimmer which does not disrupt the stroke of the swimmer. This is accomplished by provision of a waterproof digital lap counter which automatically counts and increments a count display thereby indicating the total number of laps traversed by a swimmer having the counter attached to an extremity. Automatic counting and incrementing of the count display are triggered by abutment of the waterproof lap counter against the end wall of the pool. Upon each abutment of the counter, pressure actuated means for providing an input signal indicative of a lap count is produced. The input signal is received by means for incrementally counting which then provides an output signal to the count display which in response thereto increases the visible display by one. The waterproof digital lap counter is sufficiently small and provided with means for attaching to the palm of a hand or the underside of a foot without any inconvenience to the swimmer.

In one embodiment the lap counter comprises a LCD array, which includes a digital counter, driver and LCD (liquid crystal display) mounted in an integral package.

The digital counter may be the incremental counting means while the count display may take the form of the LCD. The LCD array is embedded within a waterproof counter case which comprises an inner housing slidably and nonrotatably mounted within an outer housing. The pressure actuated means for providing an input signal indicative of a lap count may comprise a count switch arranged between the inner and outer housing. Means are provided for biasing the inner housing outwardly to define an open position for the count switch. The count switch is operable through inward movement of the inner housing relative to the outer housing to define a closed switch position producing the input signal indicative of a count. The count switch may comprise spaced contacts attached to the inner housing and a contact member affixed to the outer housing.

The LCD array, a battery providing power for the lap counter, and a printed circuit board may form an integral counter module which is mounted within a sealed cavity in the inner housing. The lap counter may further include an on/off-reset switch selectively operable to connect the battery to the LCD array and reset the LCD. The on/off-reset switch may comprise a reed switch, Hall effect sensor, or similar device, embedded in the inner housing and a permanent magnet disposed in a bezel rotatably supported on the outer housing.

DETAILED DESCRIPTION

Figure 1:
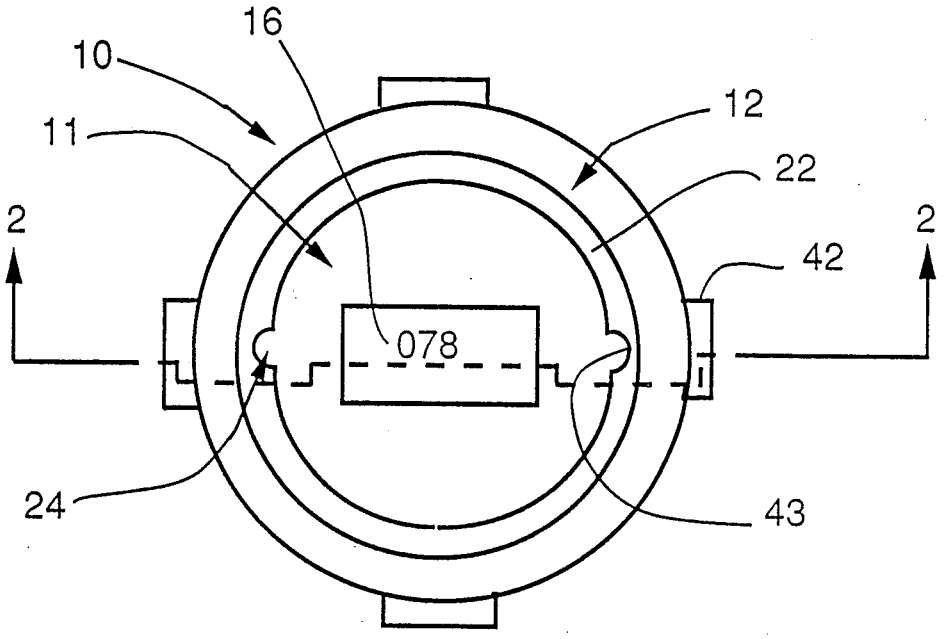
FIG. 1 is a top plan view of a waterproof digital lap counter constructed according to principles of the invention.
Figure 2:
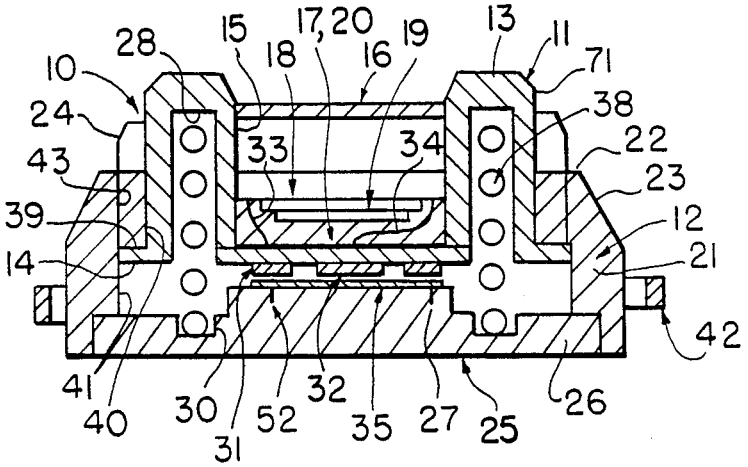
FIG. 2 is a sectional view of the waterproof digital lap counter taken along section 2—2 of FIG. 1.

An embodiment of waterproof digital lap counter constructed according to the principles of the invention is illustrated in FIGS. 1–8 of the drawings. As shown in FIGS. 1–2, the waterproof digital lap counter 10 comprises a waterproof counter case formed from a sealed inner housing 11 and an outer support housing 12. The inner and outer housing 11, 12 may be formed from a plastic material by conventional injection molding techniques. Inner housing 11 comprises a generally cylindrical body 13 and a base member 14 which is circular in shape. An annular recess 28 is formed in body 13 and spaced radially inward therefrom is a cavity 15 which contains most of the electronics necessary for operation of the digital lap counter. The cavity 15 is closed at its inner end by base 14 and at its upper end by a window 16 which may be in the form of a transparent waterproof lens integrally injection molded with the inner housing 11 to seal cavity 15. Arranged within cavity 15 is an integral package including a digital counter, driver and LCD which together define LCD array 17. Alternatively, an I/LCD or IC/LED (light emitting diode) array may be employed with the digital counter and driver to define an LED array (not shown) which operates in the same manner as the LCD array described below. The LCD array 17 is mounted directly beneath window 16 such that the LCD is visible through the window as shown in FIG. 1. The LCD array 17 may have a 6-digit display, such as the LCD's known as Red-Lion Controls "Sub-Cub I" generally available from DIGI-KEY Corporation in Thief River Falls, Minnesota. The LCD array 17 is mounted on a printed circuit board 18 which itself is mounted to a wafer-type lithium battery 19. The LCD array 17, printed circuit board 18 and battery 19 form an integrated unit hereinafter referred to as the counter module. The counter module unit is sealed at the factory to be waterproof. The battery 19 serves as the power supply for the lap counter and may have a potential between 2 and 6 volts, with 3 volts being preferred.

Figure 3:
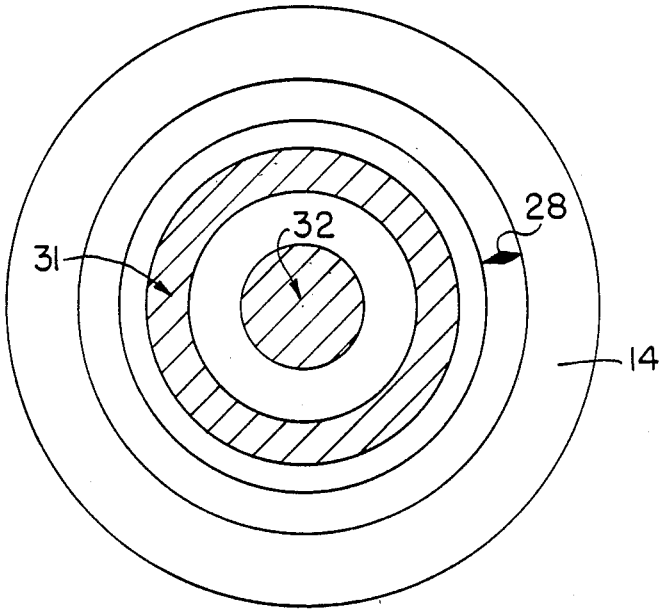
FIG. 3 is a plan view of the bottom of the inner housing of the invention.
Figure 6:
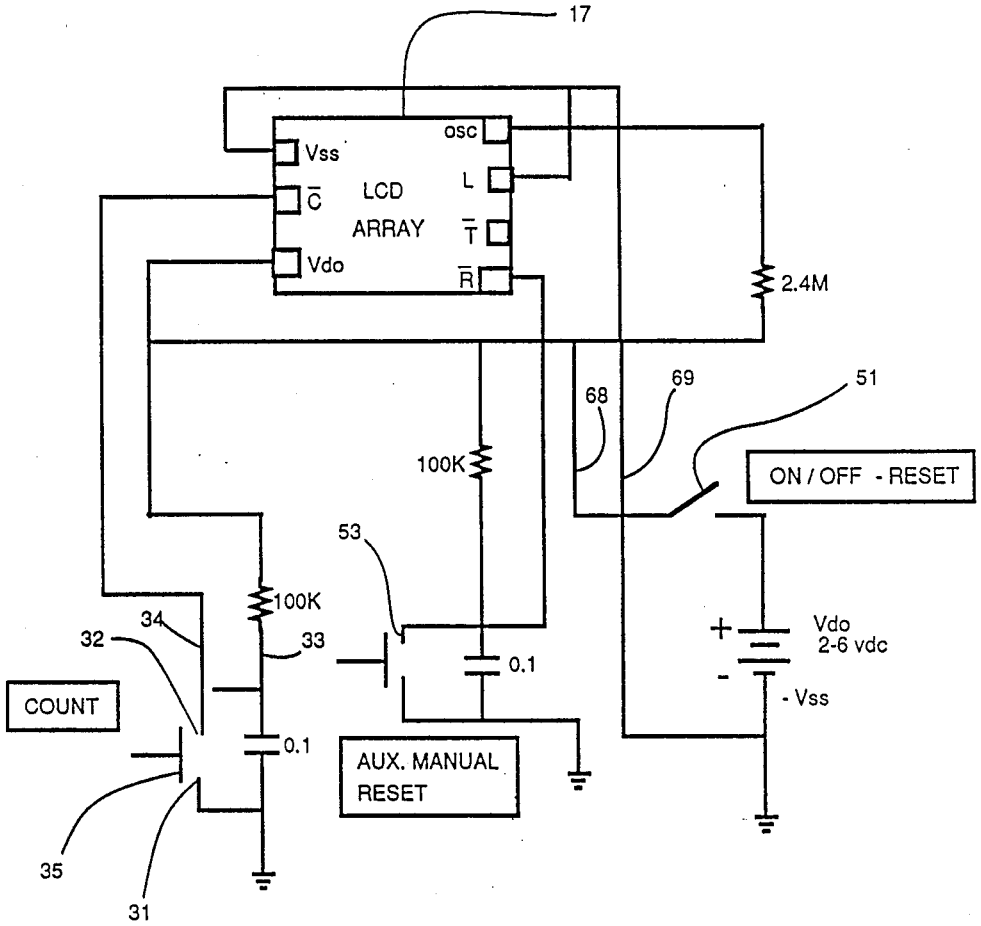
FIG. 6 is a schematic representation of an electric circuit that may be used to operate the waterproof digital lap counter.

Electrical contacts 31 and 32 are mounted to base 14 for cooperation with another contact member or bar 35 which together define a count switch shown generally in FIG. 1 and FIG. 6 as 52. Bar 35 is preferably made from a non-corrosive material. When bar 35 abuts against contacts 31 and 32, switch 52 is closed to complete a circuit which presents an input voltage signal to the digital counter of the display LCD array indicative of a count, as subsequently detailed. The digital counter receives the input voltage signal and provides an output signal to the LCD which produces a visible indication of the total number of counts received as is also discussed in detail subsequently. As shown in FIGS. 2-3 contact 31 may comprise an annular metallic ring connected to the printed circuit board 18 by wire 33. Contact 32 may comprise a circular metallic plate connected by wire 34 to the printed circuit board 18. Contacts 31, 32 and 35 and wires 33 and 34 are shown schematically in FIG. 6.

Once the electrical connections to contacts 31 and 32 have been made, the counter module is inserted into cavity 15 through the end opposite window 16. Thereafter, the base plate 14 having contacts 31 and 32 affixed thereto is permanently sealed to body 13 by means of a waterproof casting compound shown at 20 in FIG. 2. The sealing may also be accomplished by welding or gluing. In addition to wires 33 and 34, discreet electronic components, such as trimming capacitors and resistors, and additional wiring may be present within the waterproof casting compound 20.

After installation of the counter module, inner housing 11 is inserted within the outer housing 12. Outer housing 12 comprises an annular member 21 having a flat top surface 22 and a sloped side surface 23. Annular member 21 defines therethrough a stepped bore 40, 39, 41. Inner housing 11 is slidably and nonrotatably guided within outer housing 12 for axial movement by virtue of guide members 24 being slidably received in slots 43 formed in member 21 adjacent bore portion 40. Small amounts of water may enter and exit the interior of housing 12 via bore 40 without hampering operation since the counter module unit is waterproof. Guide members 24 may be integrally molded with counter case body 13. Inner housing 11 is inserted into outer housing 12 such that guides 24 are received in slots 43. A compression spring 38 then is inserted into the annular recess 28 formed in body 13 and base member 14. Thereafter, a back plate 25 is secured to annular member 21. Back plate 25 also may be injection molded and may be glued to member 21 or screwed onto member 21 by virtue of a threaded connection therebetween. Back plate 26 contains an annular recess 30 in which the inner end of spring 38 is received. Spring 38 biases inner housing 11 outwardly such that contacts 31, 32 and contact 35 are normally biased apart to define the open position of switch 52. The outer radial portion of base member 14 abuts against shoulder 39 disposed between bore portions 40 and 41 to form a stop preventing expulsion of inner housing 11 from outer housing 12. Back plate 25 comprises a circular piece 26 and an inwardly projecting member 27 which may be integrally molded with piece 26. Contact bar member 35 is affixed to member 27 by any convenient means, such as embedding the ends of contact 35 in member 27.

Figure 4:
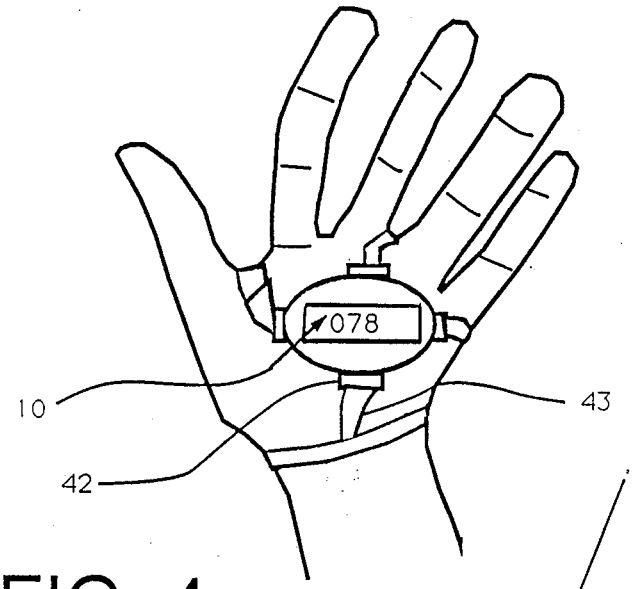
FIG. 4 shows a schematically illustrated waterproof digital lap counter attached to the hand of a swimmer.
Figure 5:
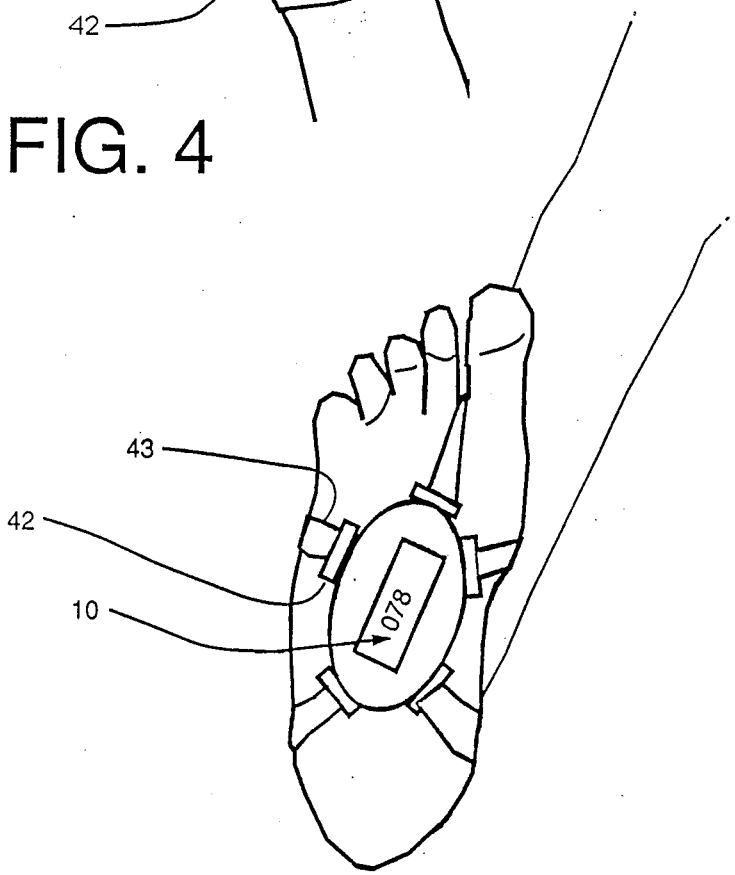
FIG. 5 shows a schematically illustrated waterproof digital lap counter attached to the foot of a swimmer.

Spaced at approximately 90 degree intervals about the lower periphery of outer housing 12 are mounting brackets 42 to which flexible straps 43, shown in FIGS. 4-5, are affixed for attachment of the lap counter to an extremity, such as a hand or foot of a swimmer. The straps must firmly secure the lap counter onto the hand or foot of the swimmer. FIGS. 4-5 schematically illustrate the waterproof digital lap counter 10 attached to the hand and foot, respectively, of a swimmer. As shown in FIG. 5, more than four brackets 42 may be provided if necessary for secure attachment of the lap counter. As subsequently discussed, when the counter is secured to the palm of a swimmer's hand, as shown in FIG. 4, operation of the lap counter is triggered upon abutment of the lap counter against the end wall of a pool during the course of swimming laps. When the lap counter is secured to the ball of the foot, as shown in FIG. 5, operation is triggered upon abutment of the lap counter against the wall during, for example, the flip turn of the swimmer.

FIG. 6 is a schematic representation of an electric circuit which may be used to operate the waterproof counter. As noted in connection with the discussion of FIGS. 1-2, the LCD array 17 and the interconnection wiring and discreet electronic components illustrated in FIG. 6 are located within the sealed inner housing 11. The count switch 52 defined by contacts 31, 32 and 35 is located within bore portion 41 of outer housing 12 as previously discussed. The count switch is momentarily closed when the swimmer presses his hand or foot against the pool wall thereby sending a voltage pulse to LCD array 17.

As previously mentioned, the LCD array 17 of FIG. 6 is an integral package which includes a LCD, a counter and other electronics. The power source comprises a battery 19 having a voltage between 2 and 6 volts, with a flatpack lithium cell of 3 volt potential being preferred. In order to save power, it is preferred that the battery be coupled through an on/off-reset switch 51 over line 68 to the terminal $V_{dd}$ of the LCD array 17. The negative terminal of the battery 19 is coupled to ground and to the $V_{ss}$ input to the LCD array. LCD array 17 has an asynchronous latch input L which is also coupled to ground. The count input $\overline{C}$ of the LCD array is coupled by a line 34 to count switch 52 which, as previously described, comprises spaced contacts 31 and 32 which are bridged by contact member 35. Terminal 32 is coupled to $V_{dd}$ by a 100K ohm resistor to maintain the input to $\overline{C}$ high when switch 52 is open. A 0.1 microfarad capacitor is coupled across the switch contacts 31, 32 for noise suppression to ensure that there is only one count registered per actuation of switch 52. The $\overline{R}$ or reset input to the LCD array 17 is coupled to an auxiliary manual reset switch 53 which similarly is coupled to $V_{dd}$ through a 100K ohm resistor and has associated therewith a noise suppression capacitor. The supply voltage $V_{dd}$ is also coupled through a 2.4 M ohm resistor to the oscillator input OSC of the LCD array 17.

The switch 53 is optional since the nature of the LCD array 17 is that it is reset upon application of power. However, in order to be able to reset the counter without turning the power off, the auxiliary manual reset switch 53 can be provided. Alternatively, the on/off-reset switch 51 can be eliminated since the power drain of the LCD array 17 is low, and utilizing a lithium cell, even with power remaining on, the expected battery life would be in excess of two years.

As indicated above, the circuit of the LCD array includes a counter, typically a BCD counter, and a decoder, e.g., a BCD to decimal decoder. Upon power on or actuation of the reset 53, the counter is reset to zero. Thereafter, each time switch 52 is operated, the voltage $V_{dd}$ through the lOOK ohm resistor which had been on the input $\overline{C}$, is brought to ground. This falling edge causes the count to advance.

Figure 7:
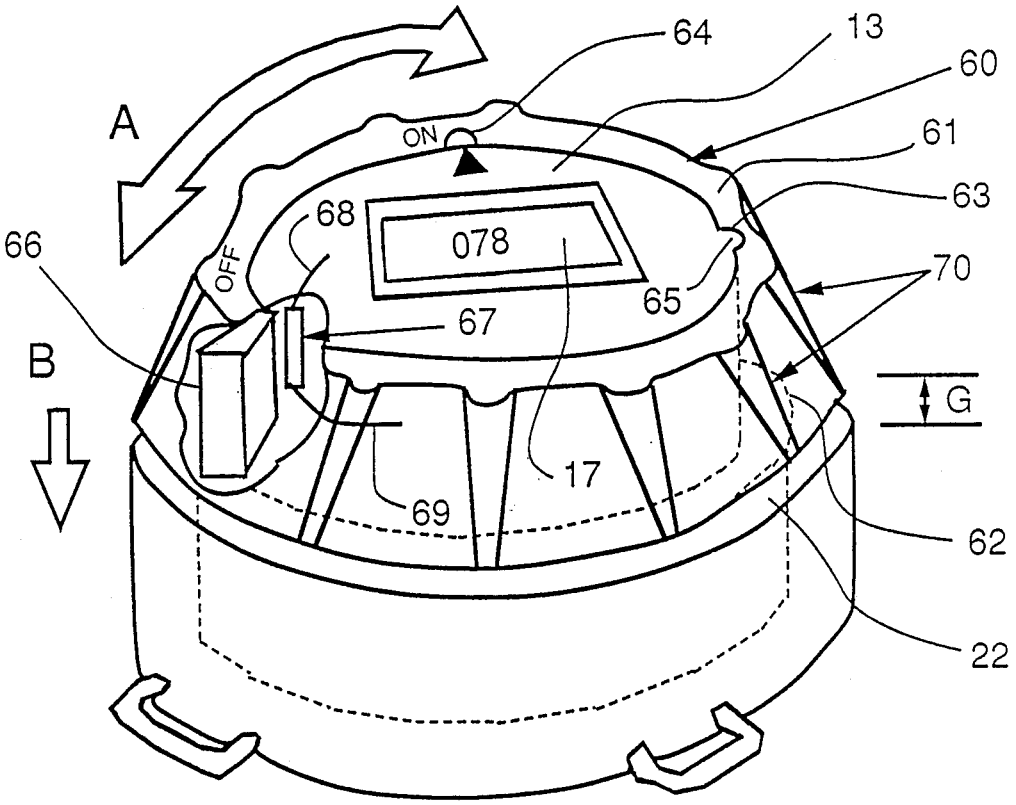
FIG. 7 is a schematic perspective view of the waterproof digital lap counter having a rotating bezel mounted thereon showing an on/off-reset switch in a cut-away view.
Figure 8:
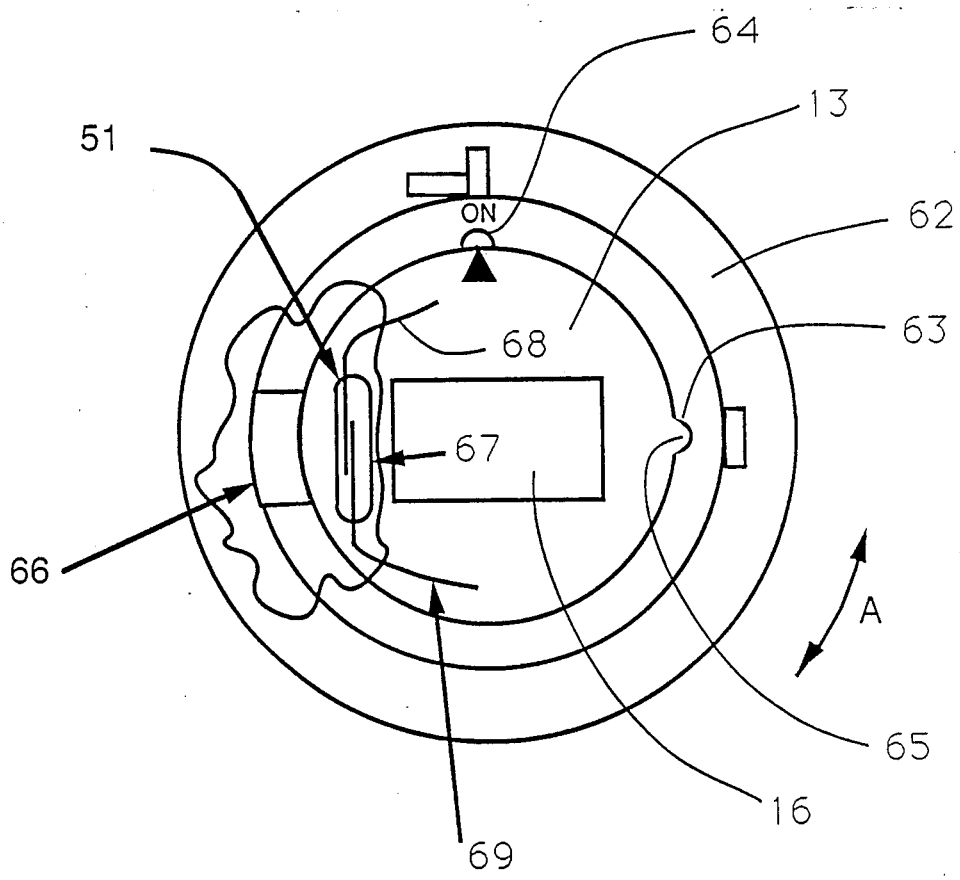
FIG. 8 is a top plan view of the waterproof digital lap counter and rotating bezel schematically shown in FIG. 7 illustrating the on/off-reset switch in a cutaway cross section.

FIGS. 7–8 show one embodiment of an on/off-reset switch schematically shown as 51 in FIG. 6. If the battery 19 is permanently connected to the LCD array, the switch illustrated in FIGS. 7–8 may be connected to the circuit to operate as the schematically illustrated auxiliary manual reset switch 53.

In either case, a rotating bezel 70 is snap fitted over member 13 and rotatably supported thereon by, for example, an annular ridge (not shown) which may be provided on surface 71 shown in FIG. 2. The annular ridge cooperates with a complementary annular recess (not shown) on the inner surface of rotatable bezel 70 for rotatably supporting the bezel thereon. The bezel is supported for rotation in the directions shown by arrow A in FIGS. 7–8. Any other means for rotatably supporting the bezel upon inner housing 11 may be employed as long as the bezel is axially spaced from surface 22 of outer housing 12 by an appropriate clearance distance G. The clearance G is required to provide the requisite relative motion between inner housing 11 and outer housing 12 needed to define open and closed positions for count switch 52.

The rotatable bezel 70 has a flat annular surface 61 and a sloped surface 62 which together define a generally truncated cone-type shape. Bezel surface 62 may be provided with a plurality of raised ribs 70 which facilitate rotation of the bezel when the lap counter is wet. Embedded in member 13 of inner housing 11 is a magnetic-sensitive device 67, such as a reed switch, Hall effect sensor or other electronic circuit, which is normally open and operable to close upon sensing the presence of a magnetic field. A semiconductor device sensitive to a magnetic field capable of triggering a transistor switch may be employed instead of a reed switch. The magnetic-sensitive device 67 is embedded in stationary member 13 which, as previously noted, cannot rotate due to the cooperation of guide ribs 24 in recesses 43. Embedded within or integrally formed as part of the rotating bezel 60 is a permanent magnetic 66 which may be rotated to a position adjacent magnetic-sensitive switch 67. Together the switch 67 and permanent magnetic 66 form the on/off-reset switch 51 shown in FIG. 6. When the bezel is rotated to the illustrated ON position in which permanent magnet 66 is adjacent magnetic-sensitive switch 67, switch 51 is closed.

Two detent positions are provided representing the ON and OFF positions of switch 51. The detent is provided by a small projection 65 extending radially outward from member 13. In the ON position of switch 51, projection 65 is received within a recess 63 formed in the surface 61 of bezel 60. Located at a position offset 90 degrees from recess 63 is another recess 64. Rotation of bezel 60 approximately 90 degrees in a clockwise direction, as shown in FIGS. 7–8, results in another detent position as stationary projection 65 is received in second recess 64. This detent position defines the OFF position of switch 51 as permanent magnetic 66 is now spaced away from and 90 degrees offset from magnetic-sensitive switch 67. As shown by the partial cutaway view of FIG. 8, magnet 66 and switch 67 are embedded in bezel 60 and member 13, respectively, below the top surface of their respective parts.

Although operation of the waterproof lap counter of the invention is thought to be readily apparent from the foregoing description, a brief description thereof is given below. The waterproof lap counter is affixed to a swimmer's hand such as shown in FIG. 4 or a swimmer's foot such as shown in FIG. 5. The LCD array is turned on and the LCD set to zero by rotation of the rotatable bezel 60 to the ON position shown in FIGS. 7–8. As previously explained, rotation of the bezel in this manner closes switch 51 which connects battery 19 to the LCD array 17. Each time the swimmer traverses a lap and reaches the end wall of the pool, the swimmer merely presses his hand (as shown in FIG. 4) or his foot (as shown in FIG. 5) against the end wall of the pool during his usual swimming stroke or flip turn. When the inner housing 11 abuts against the wall, spring 38 is compressed such that inner housing 11 moves inwardly relative to outer housing 12 to close switch 52 by virtue of the momentary connection between spaced contacts 31, 32 and contact bar member 35. The direction of this motion is shown by the arrow B in FIG. 7. The spring constant K of spring 38 is selected to be of a high enough value such that no amount of water pressure occurring during swimming will be sufficient to depress inner housing 11 relative to housing 12 to close count switch 52. Only when the swimmer's hand or foot abuts against the wall of the pool can a count be registered. Momentary closing of count switch presents a low voltage input signal to the count input $\overline{C}$ of LCD array 17 indicative of a count. After each input signal is received the digital counter provides an output signal operable to increment the LCD by one. Thus, the LCD indicates the number of input signals or counts received which is representative of the total number of laps traversed.

In addition to the ON/OFF indicia shown in FIG. 7 and FIG. 8 there may be a conversion table provided on the face of the counter case 11 for determining the distance traveled for the number of laps traversed of a standard indoor and/or outdoor pool.

The LCD or LED array previously described could be driven by an onboard programmable microcontroller with an onboard timer. The microcontroller may be programmed to display (a) the number of laps the swimmer has completed; (b) the total time taken to swim the total lap count; or (c) the time taken to swim a predetermined number of laps. The modes a, b, and c described above may be selected and programmed through the use of momentary waterproof switches which operate on principles similar to that of the on/-off-reset switch described earlier (reed switch, Hall effect sensor, etc). The switches would be connected to the microcontroller in a manner well known in the art.

What is claimed is:

1. A waterproof lap counter comprising:

a waterproof counter case of sufficiently small size to be contained within the palm of a hand of a swimmer or within the underside of a foot of a swimmer, said counter case housing all components necessary to count laps and including (i) an outer housing having an opening;

(ii) an inner housing slidably and nonrotatably mounted within the opening of said outer housing;

(iii) means for biasing said inner housing outwardly from said outer housing;

(iv) a numeric display;

(v) pressure actuated means for providing an input signal indicative of a lap count including a count switch having a plurality of spaced contacts attached to said inner housing and a contact member attached to said outer housing, said plurality of spaced contacts being spaced apart from said contact member by said biasing means to define an open position of said count switch, said inner housing being operable to move inwardly relative to said outer housing to define a closed position of said count switch in which said spaced contacts abut said contact member to produce said input signal upon abutment of said inner housing against a wall of a swimming pool during the normal stroke of a swimmer having the waterproof lap counter attached to an extremity;

(vi) means for incrementally counting receiving said input signal and providing an output signal operable to increment said number display; and (vii) a power source providing power to said numeric display and said incrementally counting means; and means for attaching said waterproof counter case to an extremity of a swimmer whereby operation of said pressure actuated means automatically increments said numeric display thereby indicating the total number of laps traversed.

2. A waterproof lap counter according to claim 1 wherein said numeric display comprises a LCD and said incrementally counting means comprises a digital counter.

3. A waterproof lap counter according to claim 2 wherein said inner housing includes a sealed cavity housing an integral counter module comprising a battery defining said power source, a printed circuit board, and a LCD array comprising said LCD and said digital counter.

4. A waterproof lap counter according to claim 3 wherein said biasing means comprises a coil spring having one end located in an annular recess in said inner housing and another end located in an annular guide groove in a base plate forming the bottom of said outer housing.

5. A waterproof lap counter according to claim 4 wherein said inner housing is formed with a radially extending projection slidably received within a recess in said outer housing.

6. A waterproof lap counter according to claim 3 wherein said inner housing includes a transparent window through which the LCD is visible.

7. A waterproof lap counter according to claim 1 wherein said attaching means comprises at least one resilient strap secured to the hand of a swimmer.

8. A waterproof lap counter according to claim 1 wherein said attaching means comprises at least one resilient strap secured to the foot of a swimmer.

9. A waterproof lap counter according to claim 3 further including a single on/off-reset switch selectively operable to connect the battery to the LCD array and reset the LCD.

10. A waterproof lap counter according to claim 9 wherein said on/off-reset switch comprises a magnetic-sensitive device and a permanent magnet.

11. A waterproof lap counter according to claim 10 wherein said on/off-reset switch has an ON position in which said switch is closed and an OFF position in which said switch is open, said ON position being defined by juxtaposition of said magnetic-sensitive device and permanent magnet.

12. A waterproof lap counter according to claim 11 wherein said magnetic-sensitive device comprises a reed switch embedded in said inner housing and said permanent magnet is disposed in a bezel rotatably supported on said outer housing, said ON and OFF positions of the on/off-reset switch being defined by rotation of the bezel relative to the inner housing.

13. A waterproof lap counter according to claim 10 wherein said on/off-reset switch comprises a semiconductor device operable to close said on/off-reset switch when juxtaposed to said permanent magnet.

14. A waterproof lap counter according to claim 3 wherein said LCD array further includes a programmable microcontroller having a timer, with said microcontroller being selectively programmable via momentary switches such that said LCD displays either the total number of laps, the total time taken to swim the total number of laps or the time taken to swim a predetermined number of laps.

15. A waterproof lap counter according to claim 1 wherein said numeric display comprises a LED and said incrementally counting means comprises a digital counter, 16. A waterproof lap counter according to claim 15 wherein said LED array further includes a programmable microcontroller having a timer, with said microcontroller being selectively programmable via momentary switches such that said LED displays either the total number of laps, the total time taken to swim the total number of laps or the time taken to swim a predetermined number of laps.

* * * * *